US007021318B2

(12) United States Patent
Byun

(10) Patent No.: US 7,021,318 B2
(45) Date of Patent: Apr. 4, 2006

(54) PORTABLE COSMETICS CASE

(76) Inventor: Young-Kwang Byun, 928-1005, Mok-dong APT, 312, Shinjeong-dong, Yangcheon-ku, Seoul 158-769 (KR)

( * ) Notice: Subject to any disclaimer, the term of this patent is extended or adjusted under 35 U.S.C. 154(b) by 203 days.

(21) Appl. No.: 10/703,571

(22) Filed: Nov. 10, 2003

(65) Prior Publication Data

US 2005/0081877 A1 Apr. 21, 2005

(30) Foreign Application Priority Data

Oct. 17, 2003 (KR) ..... 10-2003-0072600

(51) Int. Cl.
*A45D 33/24* (2006.01)

(52) U.S. Cl. ..... 132/294

(58) Field of Classification Search ..... 132/287, 132/294, 295, 297, 314, 315; 206/581, 235, 206/823, 751; 220/559; 221/226, 227, 279
See application file for complete search history.

(56) References Cited

U.S. PATENT DOCUMENTS

| | | | | |
|---|---|---|---|---|
| 1,986,246 | A * | 1/1935 | Bernhardt | 221/227 |
| 2,340,894 | A * | 2/1944 | Morrell | 221/232 |
| 2,625,262 | A * | 1/1953 | Pinkas | 221/137 |
| 2,705,576 | A * | 4/1955 | Amelio et al. | 221/232 |
| 5,318,053 | A * | 6/1994 | Barnhart | 132/297 |
| 5,330,056 | A * | 7/1994 | de la Rocha | 206/581 |
| 5,507,401 | A * | 4/1996 | Huang | 215/12.1 |
| 6,016,916 | A * | 1/2000 | Ortner | 206/581 |
| 6,241,408 | B1 * | 6/2001 | Lang | 401/17 |

* cited by examiner

*Primary Examiner*—Todd E. Manahan
*Assistant Examiner*—Rachel Running
(74) *Attorney, Agent, or Firm*—Birch, Stewart, Kolasch & Birch, LLP

(57) ABSTRACT

A portable cosmetics case includes a housing having a receipt member for cosmetic set and cosmetics to carry it and a cover, the receipt member containing the cosmetic set or the cosmetics capable of raising the above top portion of the housing to permit selection of any one to be required among the cosmetic set or the cosmetics when the cover is opened, and being entered into the housing when the cover is closed, thereby attaining simple and convenient carrying and storage thereof.

4 Claims, 8 Drawing Sheets

PORTABLE COSMETICS CASE

This non-provisional application claims priority under 35 U.S.C. § 119(a) based on Patent Application No. 2003-0072600 filed in Korea on Oct. 17, 2003, the subject matter of which is herein incorporated by reference.

BACKGROUND OF THE INVENTION

1. Field of the Invention

The present invention relates to a portable cosmetics case having automatic withdrawal function of cosmetics or cosmetic set to allow easy use the same as it requires, and more particularly, to a portable cosmetics case including a housing which has a receipt member for cosmetic set to carry it and a cover. The receipt member contains the cosmetic set or the cosmetics capable of raising the above top portion of the housing to permit selection of any one to be required among the cosmetic set or the cosmetics when the cover is opened, and being entered into the housing when the cover is closed, thereby attaining simple and convenient carrying and storage thereof.

2. Description of the Related Art

Generally, any woman goes out after completion of makeup and freshens her makeup at any time on demand. As one of usual makeup manners, she firstly paints her face with facial lotions such as skin conditioner, milky lotion, etc. to basically manage her facial skin, following by formal color makeup.

Such color makeup requires a cosmetic set including cosmetic use mirror, brush, so on. Among them, it needs several brushes for mascara, eye shadow and lipstick and other use.

Conventional cosmetics cases generally can carry one or more species of cosmetics, each of which includes a case body fitted with cosmetic set such as the cosmetic brush at one side of the case body and a cover having a mirror hinged to top portion of the case and pivotally folding at constant angle to open/close top portion of the case body.

However, since such a conventional cosmetic case receives the cosmetics at a level with the cosmetic set and has a drawback to cause inconvenience to handle and use it since the cosmetic set is stained with the cosmetics due to movement of the cosmetic set received inside the case when carrying and using the case. Additionally, it involves disadvantages to damage the cosmetic set and/or to generate noise by movement of the cosmetic set.

SUMMARY OF THE INVENTION

It is, therefore, an object of the present invention is to eliminate the above problem, in particular, to provide a cosmetics case capable of being conveniently used and carried including a housing having a receipt member to carry a cosmetic set inside and a case cover. The receipt member contains the cosmetic set and/or the cosmetics capable of raising the above top portion of the housing to permit selection of any one to be required among the cosmetic set and/or the cosmetics when the cover is opened, and being entered into the housing when the cover is closed, thereby attaining simple and convenient carrying and storage thereof.

BRIEF DESCRIPTION OF THE DRAWINGS

The above object, features and advantages of the present invention will become more apparent to those skilled in the related art from the following detailed description for preferred embodiments taken in conjunction with the accompanying drawing, in which.

DETAILED DESCRIPTION OF THE PREFERRED EMBODIMENT

The present invention will be described in more detail be reference to the following embodiments which are presented for purpose of illustration and should not be construed to limit the scope of the invention thereto.

Firstly, structural construction of the present invention is described as follows with reference to the accompanying drawings.

Figure 1:
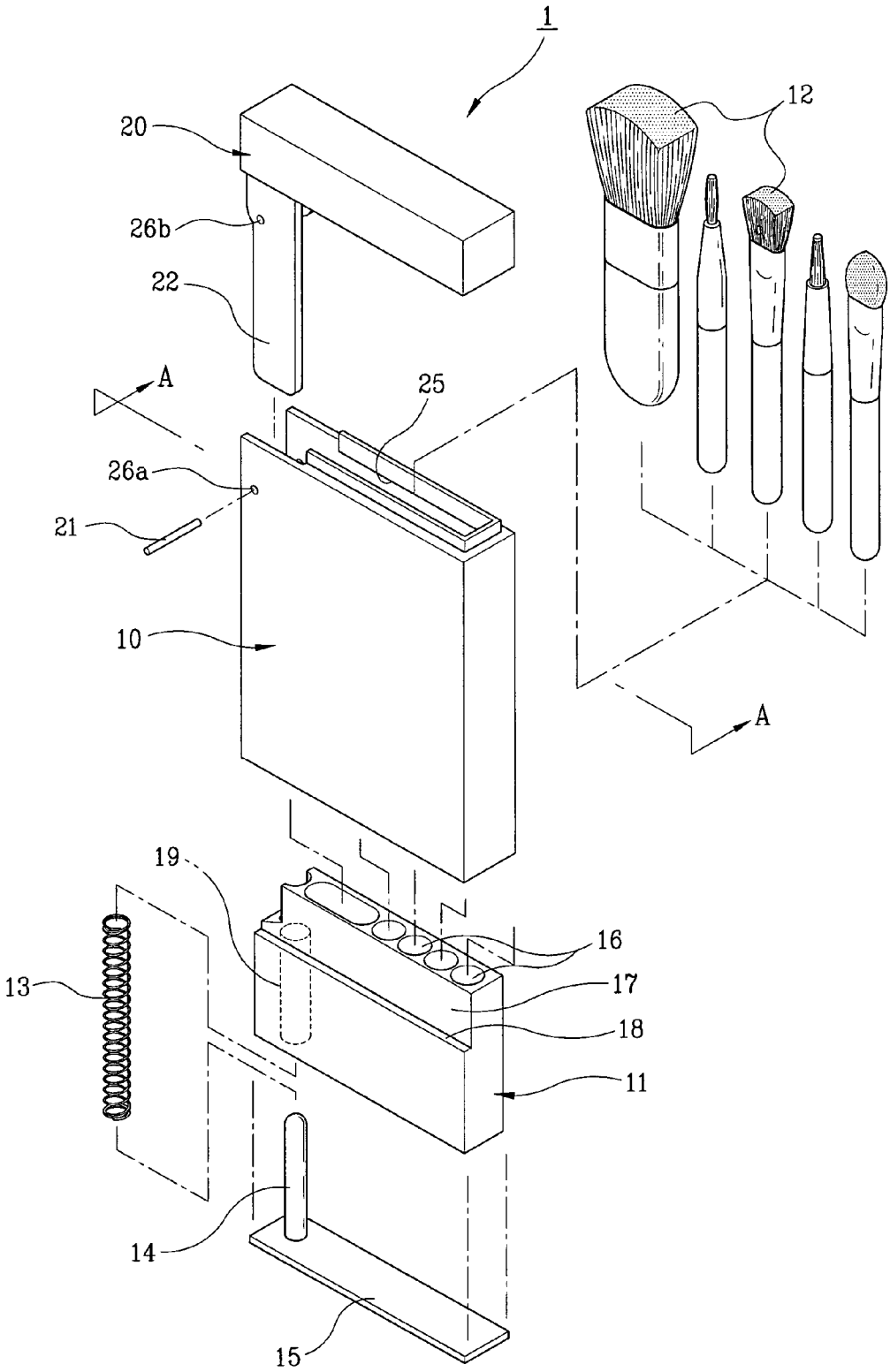
FIG. 1 is an exploded perspective view of a cosmetics case according to the present invention.
Figure 2:
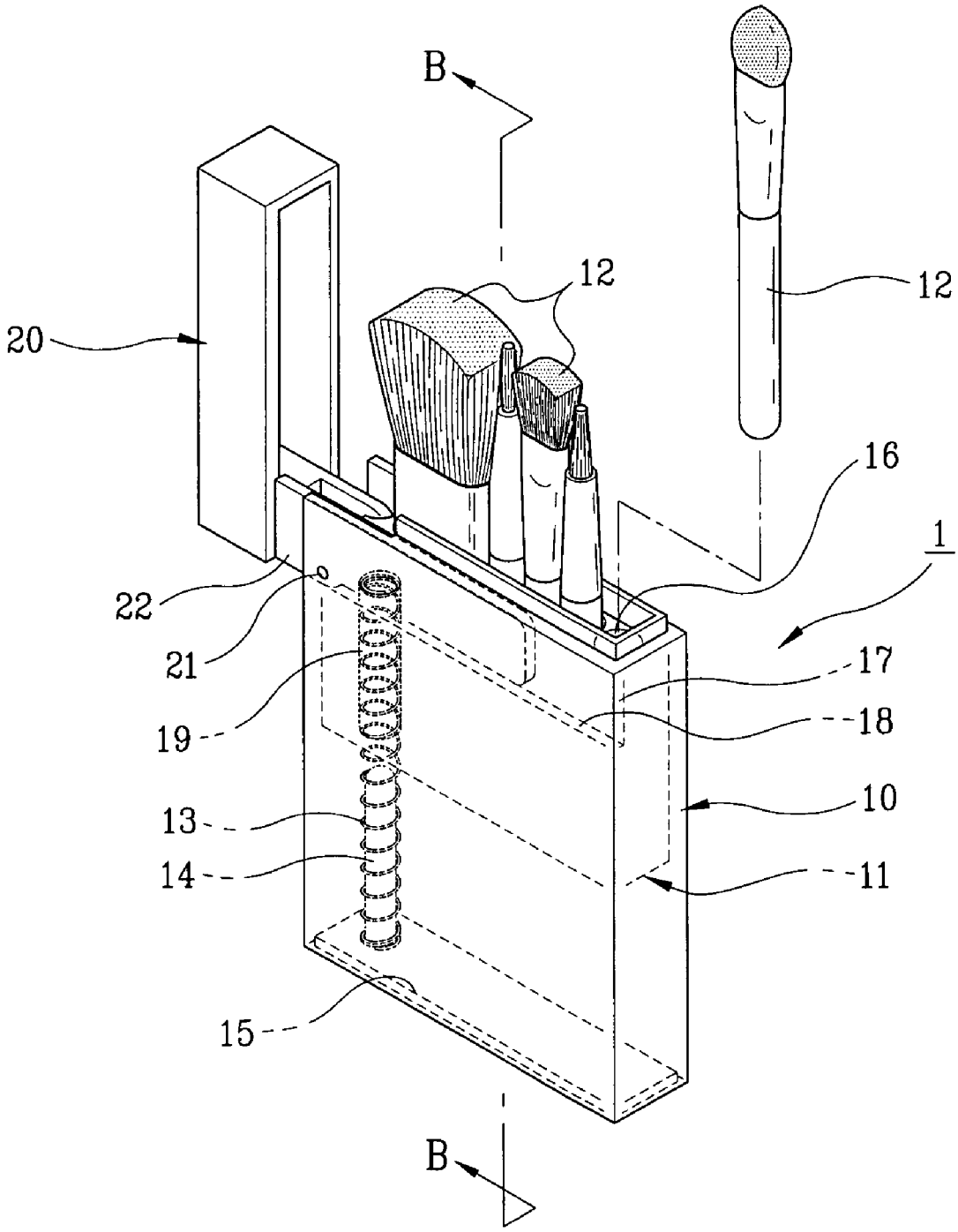
FIG. 2 is a perspective view of the cosmetics case according to the present invention, showing it after opening a cover.
Figure 3:
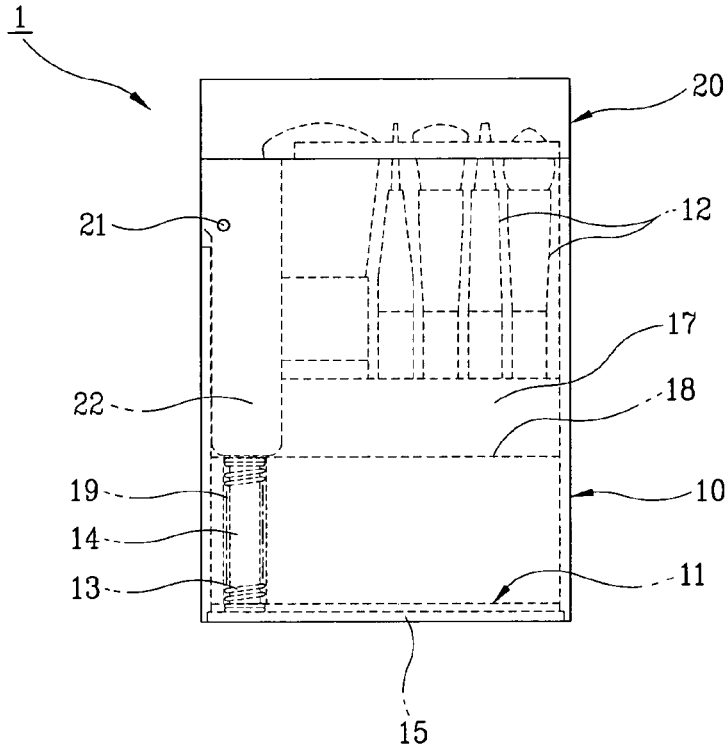
FIG. 3 is a sectional view of the cosmetics case according to the present invention, showing it in an assembly status.
Figure 4:
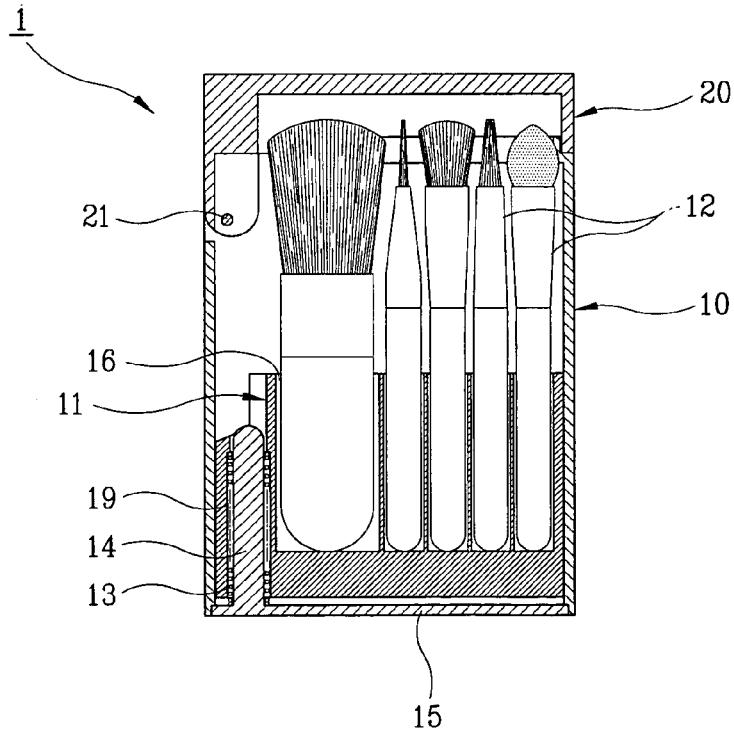
FIG. 4 is a sectional view of the cosmetics case taken along the line A—A of FIG. 1.
Figure 5:
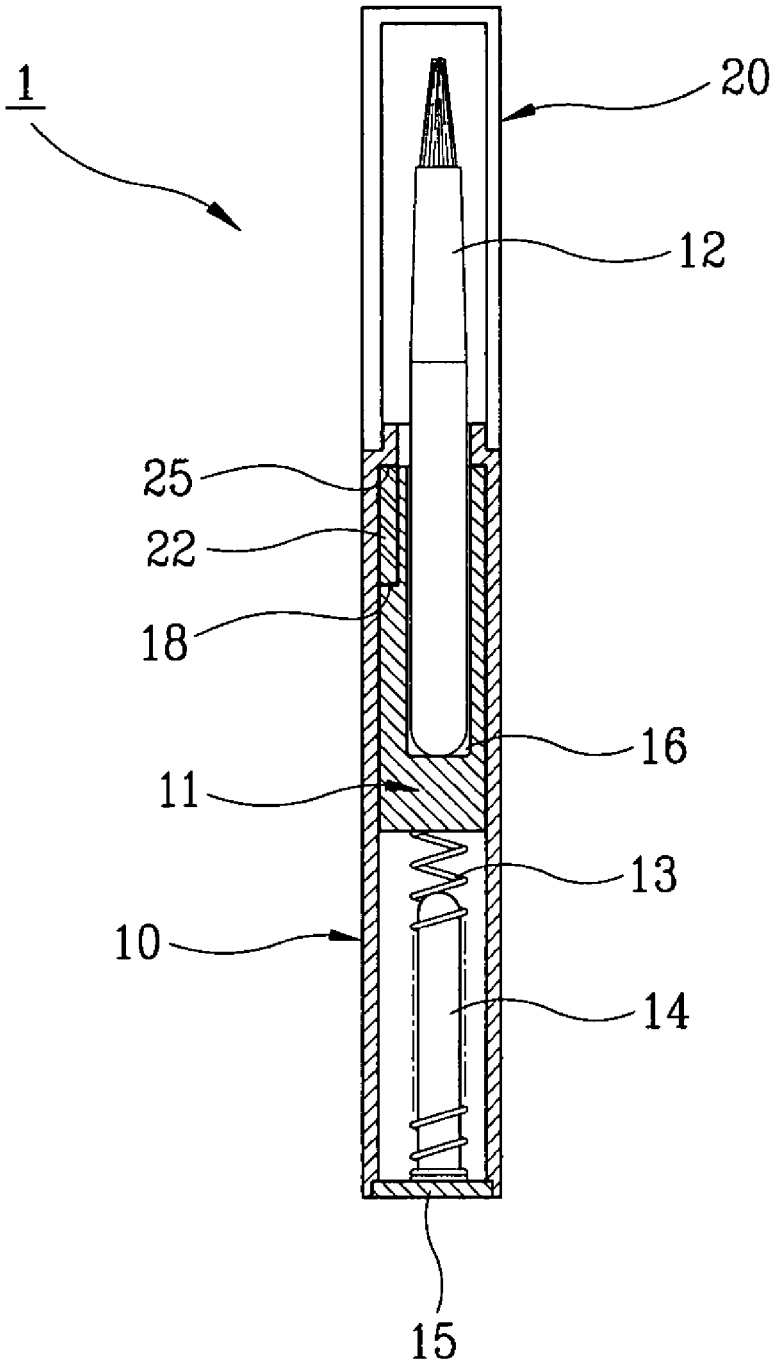
FIG. 5 is a sectional view of the cosmetics case taken along the line B—B of FIG. 2.

FIG. 1 illustrates an exploded perspective view of a cosmetics case 1 according to the present invention. FIG. 2 is a perspective view of the cosmetics case according to the present invention, showing it after opening a cover. FIG. 3 illustrates a sectional view of the cosmetics case according to the present invention, showing it in an assembly status. FIG. 4 shows a sectional view of the cosmetics case, taken along the line A—A of FIG. 1.

The cosmetics case 1 according to the present invention comprises a housing 10 opened at top portion thereof and a cover 20 pivotally hinged and coupled at top portion of the housing 10 to close the housing 10.

Inside the housing 10, a receipt member 11 is fitted to receive multiple cosmetic sets 12 and includes an elastic coil spring 13 at bottom portion thereof, which is fixed around outer side of a guide bar 14 arranged perpendicular to a bottom plate 15 thereof in order to push the receipt member 11 upward.

The receipt member 11 is formed with fitting grooves 16 to receive the cosmetic sets 12 provided according to cosmetic purposes thereof on the top portion thereof, while possessing an inserting groove 19 inserted with the guide bar 14 on a part of bottom to allow the latter to move into/out of the inserting groove 19.

Furthermore, on a part of the top portion of the receipt member 11, provided is a pushing plate receiver 17 having a threshold 18 to be fitted and connected with a pushing plate 22.

The pushing plate 22 is perpendicular to the cover 20 at one side of the cover 20 coupled to top portion of the housing 10. The pushing plate 22 is characterized to be extended and fitted into the pushing plate receiver 17 formed on the top portion of the receipt member 11 by a hinge 21 to freely move, and coupled by the hinge 21 to make the cover 20 and the housing 10 to be integrated.

Practical use and features of the cosmetics case 1 with such construction described above will be illustrated as follows:

FIGS. 3 and 4 illustrate the cosmetics case 1 according to the present invention in a closed state.

As shown in FIGS. 3 and 4, when the user intends to use the cosmetic set 12, the cover 20 is opened around the hinge 21 as an axis by opening the cover 20 and, simultaneously, the cosmetic set 12 is protruded above the housing 10 by the coil spring 13 mounted around outside of the guide bar 14 bouncing upward to push the receipt member 11 upward (FIG. 2).

Thus, the user can use desired one of the cosmetic sets 12 by pulling it out of a corresponding fitting groove 16. After completion of its use, the cosmetic set 12 is returned to the fitting groove 16 and the housing 10 is closed by the cover 20.

When the cover 20 closes the housing 10, bottom end of the pushing plate 22 positioned on one side of the cover 20 is sliding as it is connected to the threshold 18 of the receipt member 11 and forcibly presses down the threshold 18, whereby the receipt member 11 faces downward.

In such case, when the housing 10 is completely closed by the cover 20, since the pushing plate 22 perpendicular to the cover 20 presses the receipt member 11 and retains the cosmetic set 12 within the housing 10 as the carrying and storage status.

The cosmetics case 1 according to the present invention is advantageous to simply and conveniently use and carry the cosmetic set 12 by opening and/or closing the cover 20 to generate pivotal force of the pushing plate 22 and to forcibly permit the receipt member 11 located in the housing 10 to move upward and downward by the pivotal force.

The housing 10 includes a stopper 25 for inhibiting release of the pushing plate 22 out of the top portion of the housing 10, and a pair of hinge holes 26*a* and 26*b* disposed on the housing 10 and the cover, respectively.

Figure 6:
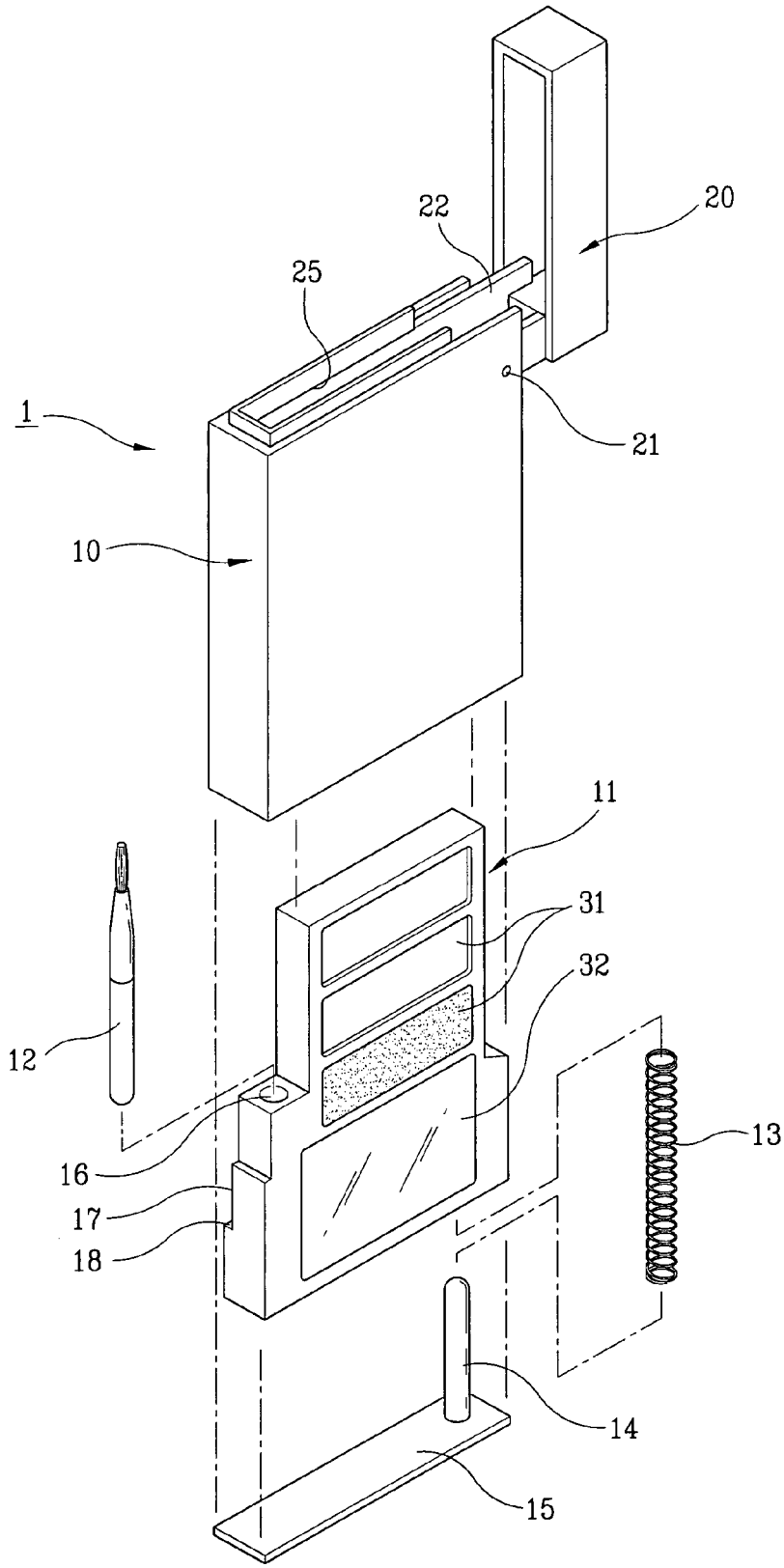
FIG. 6 is an exploded perspective view of a second embodiment according to the present invention.
Figure 7:
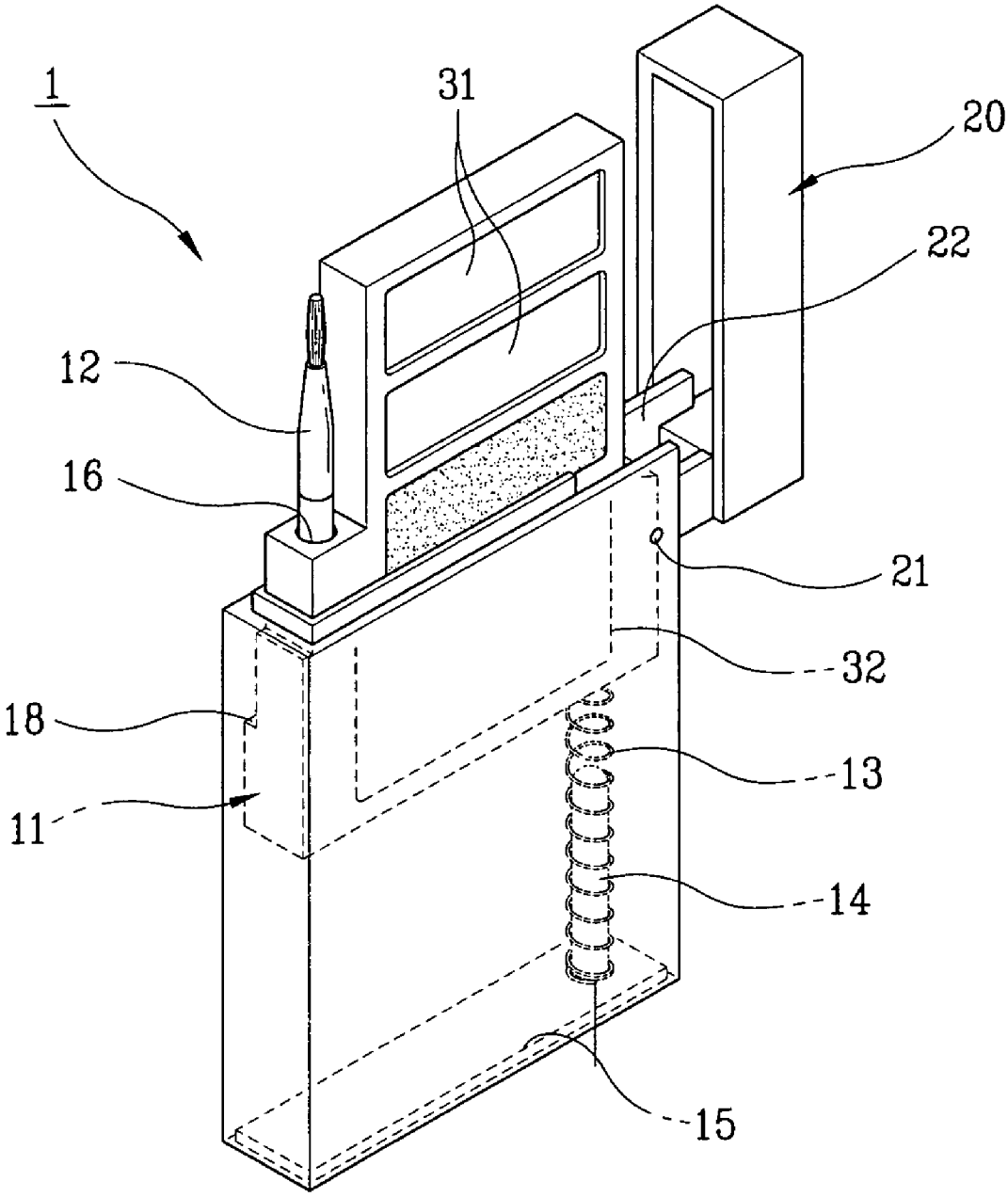
FIG. 7 is an assembled perspective view of the second embodiment according to the present invention, showing it in an assembly status.

FIGS. 6 and 7 are an exploded perspective view and an assembled perspective view of a second embodiment according to the present invention which is entirely and substantially identical to the first embodiment described above, except that it adapts a modification of the receipt member 11. More particularly, the second embodiment comprises a number of dent storage parts 31 divided and formed at one side of the receipt member 11*a* to carry various cosmetics with different uses and colors.

Additionally, provided is a cosmetic mirror 32 under the storage parts 31 reflecting face of the user to support the makeup work. Since the mirror 32 is mounted in the housing 10, it is preferable to make the housing 10 with transparent material able to reflect the user's face in the cosmetic mirror 32.

Figure 8:
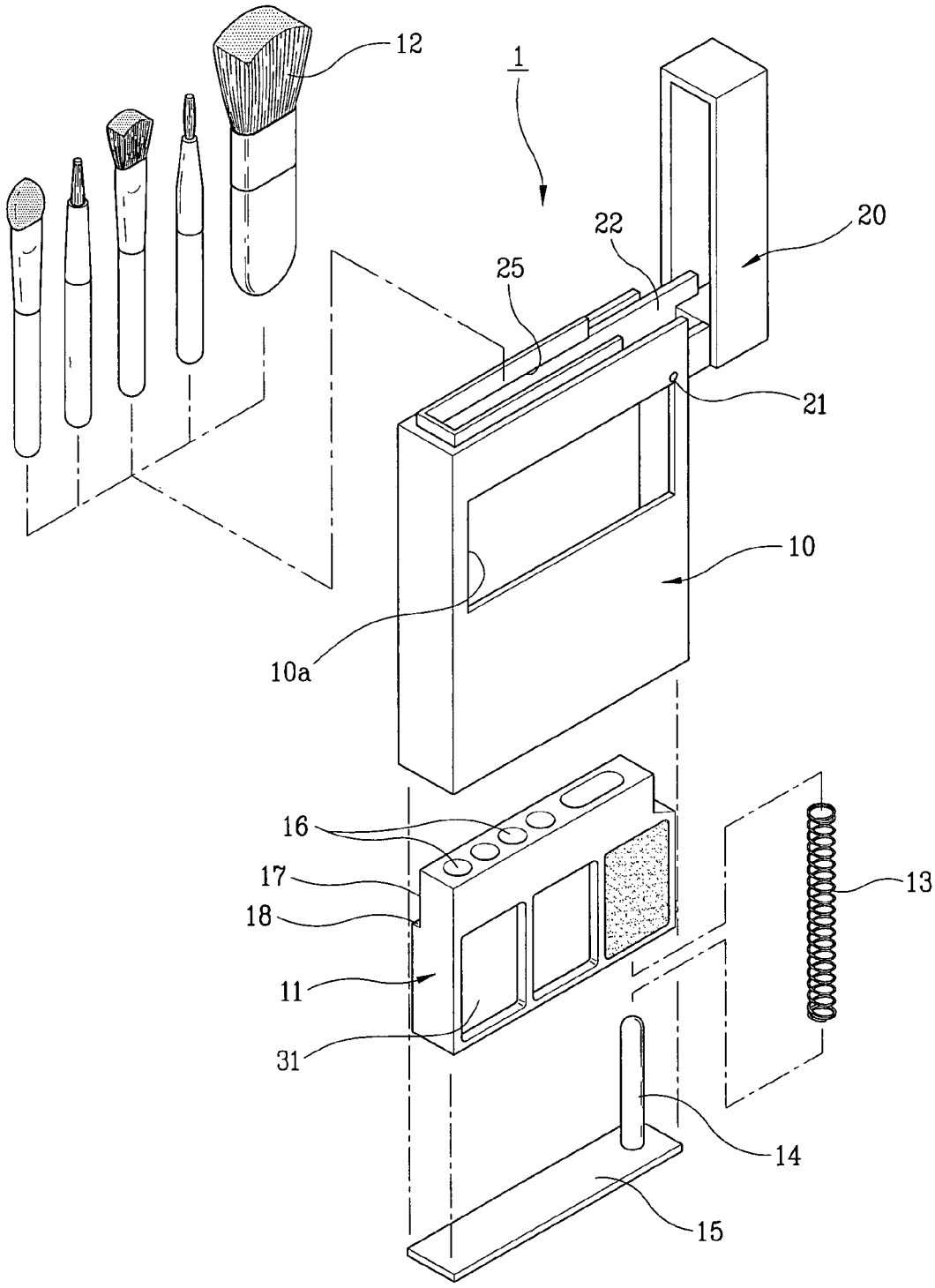
FIG. 8 is an exploded perspective view of a third embodiment according to the present invention.
Figure 9:
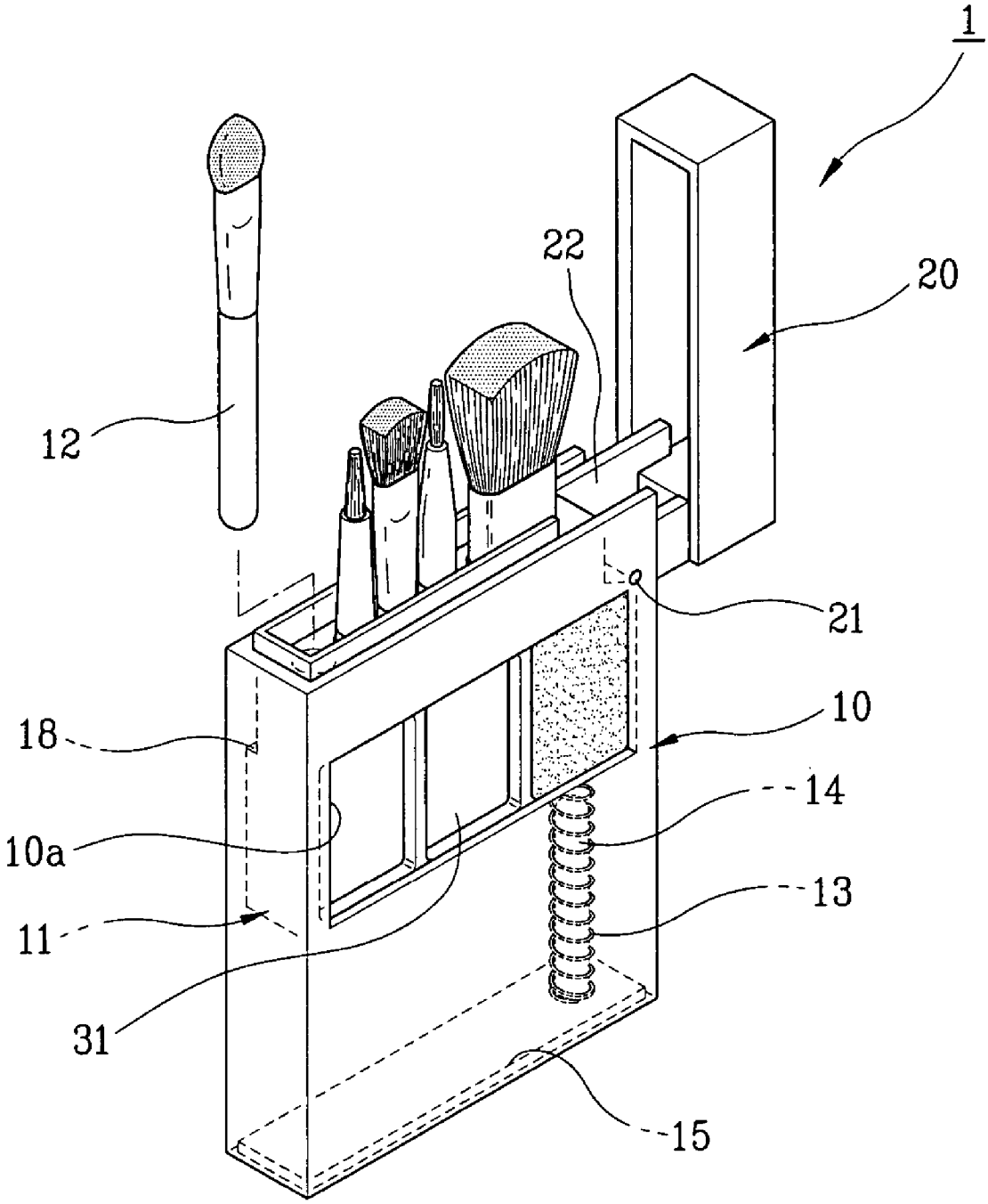
FIG. 9 is an assembled perspective view of the third embodiment according to the present invention, showing it in an assembly status.

FIGS. 8 and 9 are an exploded perspective view and an assembled perspective view of a third embodiment according to the present invention which is entirely and substantially identical to the first embodiment described above, except that it further includes a number of storage parts 31 for carrying cosmetics divided and formed at one side of the receipt member 11*b* to carry various cosmetics, for example, lipsticks with different colors and an opening part 10*a* at one side of the housing 10.

Accordingly, the user can draw the cosmetic set 12 out of top portion of the housing 10 by opening the cover 20 to raise the receipt member 11 above the housing 10. The storage parts 31 reach a position corresponding to the opening part 10*a* of the housing 10 by opening the cover 20 to allow the cosmetics to be used.

Accordingly, the portable cosmetics case according to the present invention which includes the receipt members 11, 11*a* and 11*b* for cosmetic set 12 in the housing 10 to move upward and downward by opening and closing the cover 20 at top portion of the housing 10 in order to selectively use desirable one among several cosmetic sets 12 on demand and to attain convenient and simple carrying and use thereof.

What is claimed is:

1. A portable cosmetics case comprising:

a housing including a receipt member, and a cover having a pushing plate for pivotally coupling to the housing by a hinge, the receipt member fitted into the housing containing;

a plurality of cosmetic sets for raising the above the housing by a coil spring at bottom portion of the housing, and an inserting groove for receiving the coil spring surrounding a guide bar which is supported on the bottom portion of the housing, whereby the pushing plate at one side of the cover releases and presses the receipt member for making the latter to move upward and downward.

2. The portable cosmetics case of claim 1, wherein the receipt member includes a pushing plate receiver having a threshold at one side of the top portion thereof in which the pushing plate of the cover is mounted to freely move.

3. The portable cosmetics case of claim 1, wherein the receipt member includes only a storage part and a cosmetic mirror at one side thereof for using it through the transparent housing.

4. The portable cosmetics case of claim 1, wherein the receipt member additionally includes a cosmetics storage part at one side thereof and an opening part in the housing for allowing the cosmetics in the cosmetic storage part to be used when the cosmetic storage part moves upward.

* * * * *